US006317581B1

(12) United States Patent
Boehmer et al.

(10) Patent No.: US 6,317,581 B1
(45) Date of Patent: Nov. 13, 2001

(54) PRINTER WITH TWO PRINTING UNITS AND METHOD FOR ITS OPERATION

(75) Inventors: Georg Boehmer, Munich; Joseph Dietl; Hans Hahn, both of Unterhaching; Bernward Heller, Kirchheim; Hubert Mugrauer, Zorneding; Otto Olbrich, Taufkirchen; Reinhold Rigauer; Otto Rotheimer, both of Erding; Rudolf Seeberger, Lochham, all of (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/769,597

(22) Filed: Jan. 25, 2001

Related U.S. Application Data

(6362) Continuation of application No. 09/297,162, filed as application No.PCT/DE97/02451 on Oct. 22, 1997.

(30) Foreign Application Priority Data

Oct. 22, 1996 (DE) ..... 196 43 654

(51) Int. Cl.[7] ..... G03G 15/00; G03G 21/00
(52) U.S. Cl. ..... 399/401
(58) Field of Search ..... 399/364, 388, 399/397, 401; 355/24

(56) References Cited

U.S. PATENT DOCUMENTS 4,591,884 * 5/1986 Miyamoto et al. ..... 399/374 X
4,783,681 * 11/1988 Tanaka et al. ..... 355/24 X
4,972,236 * 11/1990 Hasegawa ..... 399/16
5,150,167 * 9/1992 Gonda et al. ..... 399/16
5,208,640 * 5/1993 Horie et al. ..... 399/110
5,598,257 * 1/1997 Keller et al. ..... 399/364
6,101,364 * 8/2000 Boehmer et al. ..... 399/364 X

* cited by examiner

*Primary Examiner*—Fred L. Braun
(74) *Attorney, Agent, or Firm*—Schiff Hardin & Waite

(57) ABSTRACT

A printing device, in particular a printer or a copier, and method for its operation which includes a first electrographic printing unit for printing an image pattern on a sheet-type material in a first transfer printing transport path as well as a second electrographic printing unit for printing an image pattern on a sheet-type material in a second transfer printing transport path, and further including an input section via which the sheet-type material can be supplied individually one after the other to both the first and second electrographic printing units, and further having an output section via which the printed sheet-type material from either the first or second electrographic printing units is ejected individually one after the other. The first and second printing units are in first and second transfer printing transport paths that are connected by connecting paths that form first and second rings. The first ring has a supply channel, the second ring has a carry off channel and a two direction connecting channel is between the first and second transfer printing transport paths.

25 Claims, 8 Drawing Sheets

PRINTER WITH TWO PRINTING UNITS AND METHOD FOR ITS OPERATION

This application is continuation of Ser. No. 09/297,162 filed Oct. 6, 1999, which is a 371 of PCT/DE97/02451 filed Oct. 22, 1997.

BACKGROUND OF THE INVENTION

1. Field of the Invention

The present invention relates to a device or, respectively, a system, in particular a printer or copier, with two electrographic printing units of substantially the same type, wherein each of the printing units prints an image pattern on a sheet-type material. The device includes having an input section via which the sheet-type material can be supplied individually in successive fashion and an output section via which the printed sheet-type material is ejected individually in successive fashion.

2. Description of the Prior Art

Electrophotographic printers of this type are known, for example, from DE 34 16 252 A1, EP 0 104 022 A2, DE-PS 1,280,605, DE 34 07 847 A1 or WO 91/13386. With printers of this type, high printing performance can be achieved, even in duplex operation, as long as both printing units are working as they should. However, the devices specified in the cited publications have the disadvantage that, in the case of failure of one of the printing units, a drastic reduction in the performance of the duplex operation results. This is because a sheet that is to be printed on both sides in duplex operation must then be accelerated repeatedly in the opposite direction in order to enable it to be printed on both sides by the one remaining printing unit.

From U.S. Pat. No. 5,150,167, a printing unit is known that contains two printing units. One of the printing units has a priority status. As such, sheets that have been printed in the lower-order printing unit additionally can be printed in the priority printing unit. However, if the priority printing unit fails, double printing and, in particular, duplex printing is not possible.

From U.S. Pat. No. 5,208,640 A, a further print apparatus is known that contains several printing units. The printing units are connected with one another via a ring system wherein a common turning apparatus with a shunt for all printing units is used. If the turning apparatus fails, e.g. due to a switching error in the shunt, duplex operation is no longer possible.

An object of the present invention, is to therefore, provide a device, in particular a printer or a copier, that has a high print performance or, respectively, copier performance, in particular in duplex operation.

SUMMARY OF THE INVENTION

This object is solved for the device, or system, named above in that a first printing unit and a substantially identical second printing unit are provided in the device, to which sheet-type material can be supplied via the common input section. The sheet-type material printed by the second printing unit is ejected via a common output section. The two transfer printing transport paths of the two printing units are respectively connected via connecting paths to form two ring systems. A shunt is respectively provided at each of the two rings by means of which the sheet-type material can be turned independent of the respective other shunt in the allocated ring.

In the device of the present invention, two printing units of substantially similar construction are used. The components for these printing units, e.g. the electronic control unit, the developer units, the toner supply and carry-off means, etc., can be retained almost unchanged. Each printing unit, therfore, has in itself a very high operational reliability. Both printing units use a common input section via which the sheet-type material is supplied. Likewise, both printing units use in common an output section for carrying away the printed sheet-type material. The new device is thereby constructed very compactly and can be manufactured at a low expense. The print performance is increased significantly due to the two printing units. Also by means of the inventive ring system, a sheet-type material printed by one of the two printing units can again be supplied to the same printing unit in the same direction as in the first print process.

According to an embodiment of the present invention, a first transfer printing transport path is provided for the first printing unit and a separate second transfer printing transport path is provided for the second printing unit. The transfer printing for both printing units takes place with the same speed. Since each printing unit has a separate transfer printing transport path, sheet-type material can be printed with one printing unit even upon failure of the other.

In addition, it is particularly advantageous if the two rings are connected via two three-way shunts. A multiplicity of transport paths arises by this arrangement.

An embodiment of the present invention provides that the input section contains a shunt that supplies sheet-type material either to the first transfer transport path or to the second transfer printing transport path. In this embodiment, the simplex printing operating mode is performed with one color; i.e., supplied sheet-type material (e.g., individual sheets of paper) are printed on one side by the first printing unit or by the second printing unit. In a further development, the shunt supplies sheet-type material alternately to the first transfer printing transport path and to the second transfer printing transport path. Since each printing unit prints the sheet-type material with the same transfer printing speed, and two printing units are arranged in parallel, the print performance in the device is doubled. Accordingly, individual sheets can be supplied and carried away with twice the print speed.

Another embodiment provides that the first transfer printing transport path and the second transfer printing transport path are connected by a connecting channel through which sheet-type material can be conveyed in one or in both transport directions. By means of these measures, printed material can be supplied from the first printing unit to the second printing unit, and from the second printing unit to the first printing unit, in order to be printed. The connecting channel also creates a feedback that connects the two printing units with one another, thus enabling many print processes.

Another embodiment provides that the sheet-type material is turned during its transport from the first transfer printing transport path to the second transfer printing transport path.

In this way, each printing unit can print both the front side and the back side of an individual sheet. If developer stations with different colors are used for the two printing units, then two image patterns with two different colors can be printed on each side of the individual sheet; i.e., what is known as two-color duplex operation, or duplex color spot operation, can be performed.

According to another embodiment of the present invention, a printer system is specify in which two devices of the same type are connected by an interchange apparatus that supplies the sheet-type material printed by the first device to the second device of the same type. If each of these two devices contains differently colored printing, units, then individual sheets can be printed on both sides with four colors. Of course, other variants are conceivable as well; e.g., one device prints two colors on one side and the other device prints two colors on the other side.

Additional features and advantages of the present invention are described in, and will be apparent from, the Detailed Description of the Preferred Embodiments and the Drawing.

DESCRIPTION OF THE DRAWING

Embodiments of the invention are explained below on the basis of the drawing.

DETAILED DESCRIPTION OF THE PREFERRED EMBODIMENTS

Figure 1:
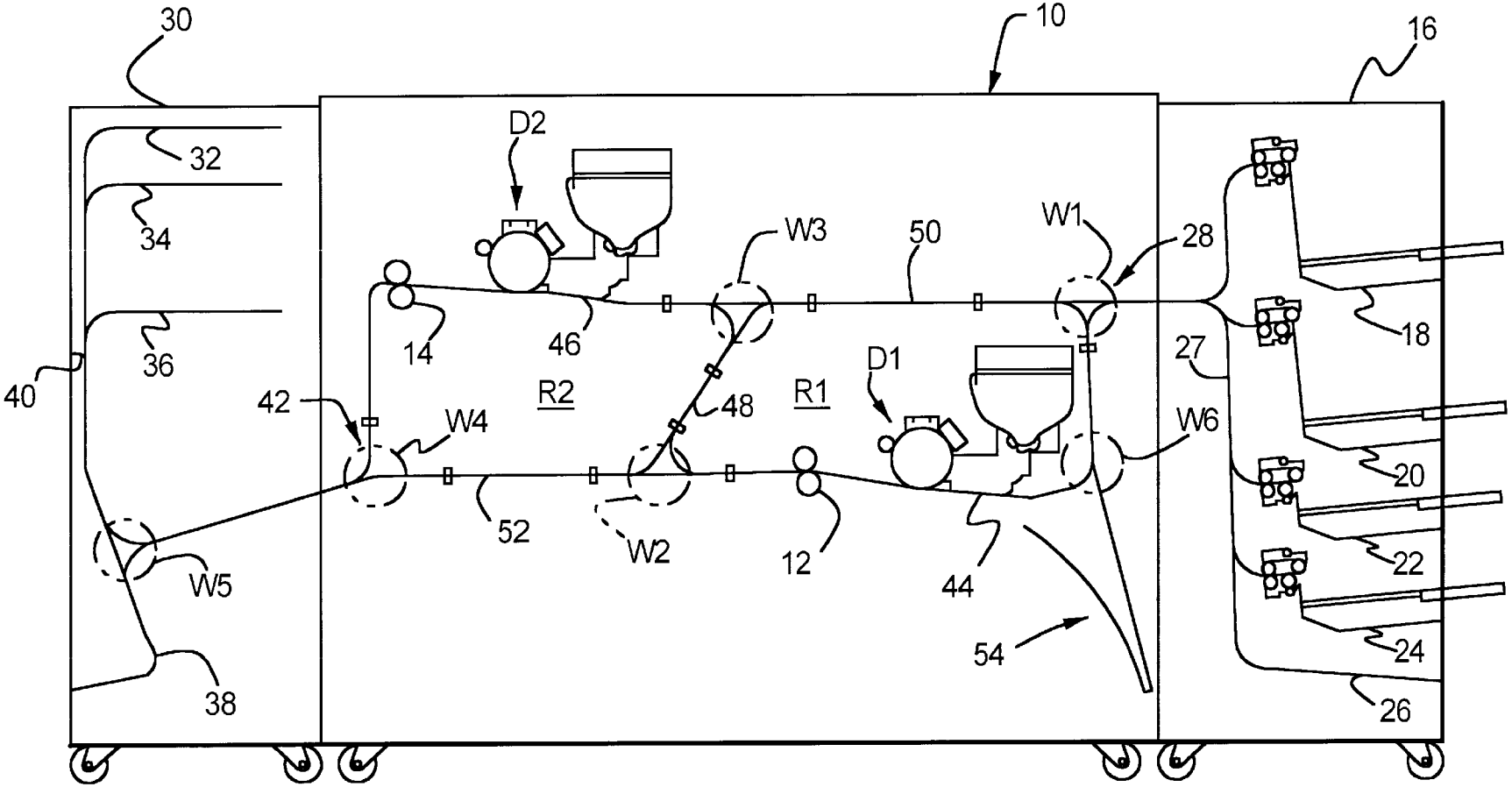
FIG. 1 schematically shows the construction of a high-performance printer in accordance with the present invention.

FIG. 1 shows a high-performance printer 10 that serves for the rapid printing of individual sheets of paper. The high-performance printer 10 contains a first, lower printing unit D1, as well as a second, upper printing unit D2. Both printing units D1, D2 operate according to the known electrographic method with the same transfer printing speed. Fixing means, indicated schematically in FIG. 1 by two roller pairs 12, 14, are connected downstream from the printing units D1, D2. A paper input 16, containing several supply containers 18 to 24 with individual sheets as well as an external paper input channel 26 via which individual sheets can be supplied from the outside, is connected to the high-performance printer 10. Individual sheets are supplied to an input section 28 via a transport channel. At the output side, a paper output 30 containing several output containers 32 to 36 is connected to the high-performance printer 10. In addition, two output channels 38, 40 are provided via which individual sheets can be outputted to stations that carry out further processing. The high-performance printer 10 ejects the printed individual sheets via the output section 42.

In the interior of the high-performance printer 10, transport paths are arranged for the transport of the individual sheets, by means of which various operating modes of the high-performance printer are enabled. Transfer printing transport paths 44, 46 are respectively allocated to the printing units D1, D2, which are respectively set by means of drives in such a way that the supplied individual sheets at the printing units D1, D2 have their transfer printing speed. Both transfer printing transport paths 44, 46 are connected with one another via a connecting channel 48. The transport path about the first printing unit D1 is supplemented to form a ring R1 by a supply channel 50 via which individual sheets also can be supplied to the second transfer printing transport path 46 from the input section 28. The transport path for the second printing unit D2 is in a similar way supplemented by a carry-off channel 52 to form a ring R2, via which individual sheets printed by the printing unit D1 can be supplied to the output section 42.

A first shunt W1 is arranged between the input section 28, the first transfer printing transport path 44 and the supply channel 50. The first shunt W1 makes it possible for individual sheets to be supplied optionally to the first transfer printing transport path 44 or to the supply channel 50 from the input section 28. A further variant is that individual sheets transported on the supply channel 50 in the direction of the shunt W1 can be supplied to the first transfer printing transport path 44.

In addition, a second shunt W2 and a third shunt W3 are arranged at the ends of the connecting channel 48 wherein they respectively connect the adjoining transport paths 44, 48, 52 or, respectively 46, 48, 50. A fourth shunt W4 is located in the vicinity of the output section 42 wherein it connects the adjoining transport paths. The paper output 30 contains a fifth shunt W5 that operates as a turning means. In addition, a modulation means 54 is provided to which rejected individual sheets are supplied via a shunt W6.

By means of the arrangement specified in FIG. 1, various operating modes of the high-performance printer 10 can be enabled. In the following FIGS. 2 to 7, the various operating modes are shown schematically. The respective conveying of the individual sheets is illustrated on the basis of arrows.

Figure 2:
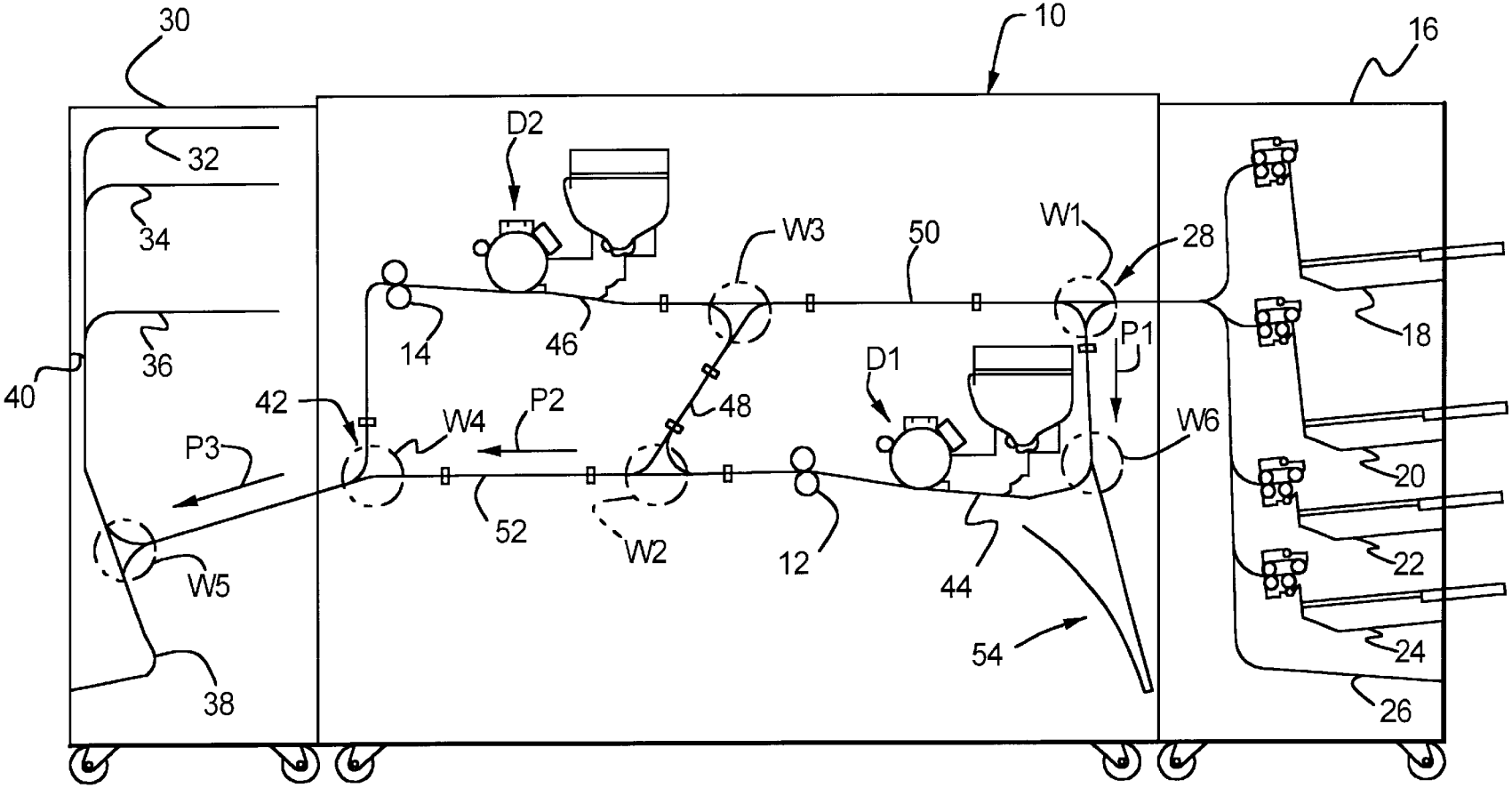
FIG. 2 schematically shows the operating mode simplex printing with the lower printing unit.

FIG. 2 schematically shows simplex printing with only one printing unit. In this simplex printing, only one side of an individual sheet is printed. The individual sheet moves via the input section 28 and the correspondingly switched shunt W1 along the arrow P1 to the first transfer printing transport path 44. It is printed at the printing unit D1. Subsequently, the individual sheet is ejected (arrow P3) into the paper output 30 along the carry-off channel 52 (arrow P2) via the output section 42.

Figure 3:
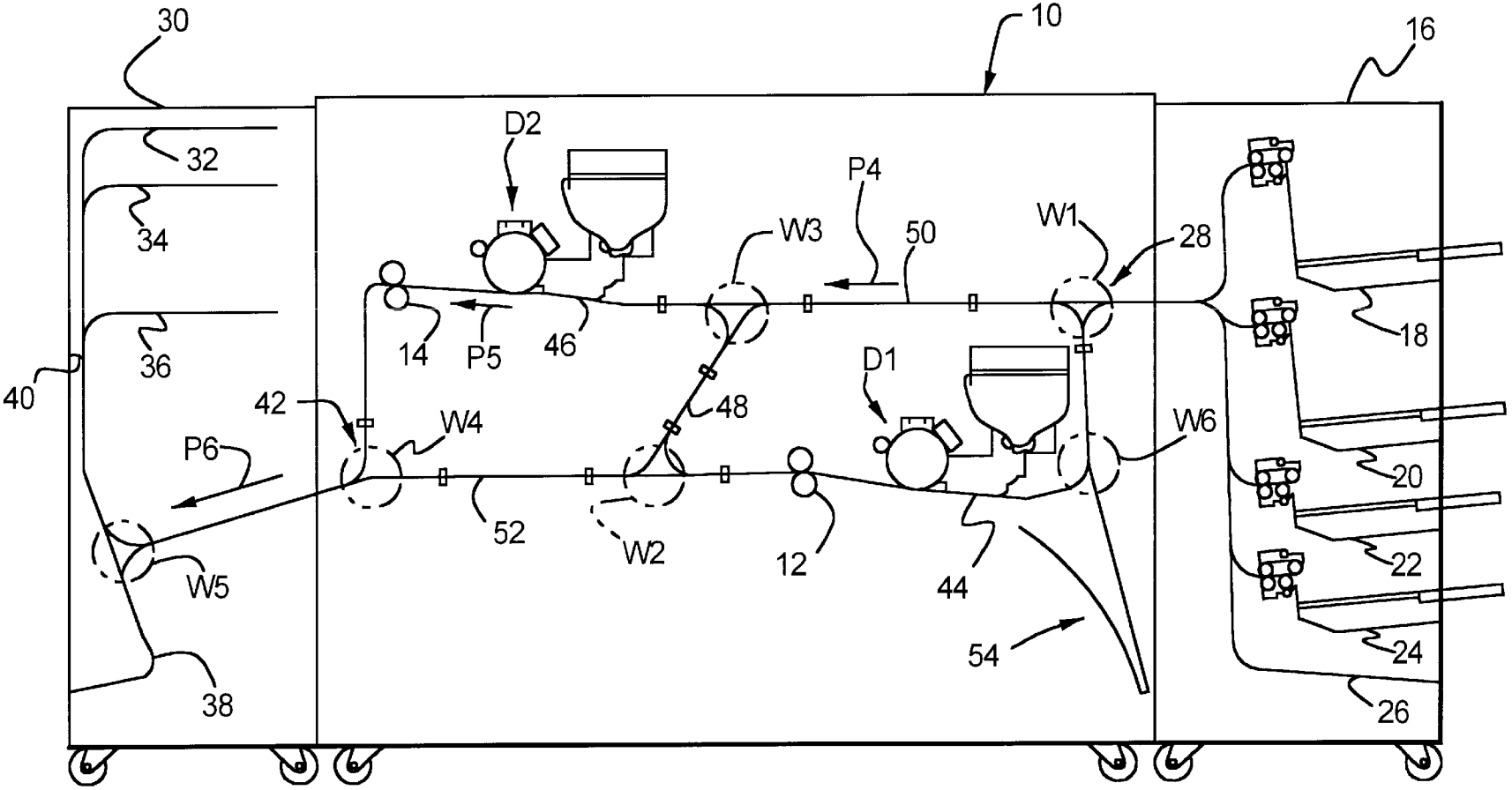
FIG. 3 schematically shows the operating mode simplex printing with the upper printing unit.

FIG. 3 shows simplex printing with the upper, second printing unit D2. The transport of the individual sheet takes place via the supply channel 50 (arrow P4), the second transfer printing transport path (arrow P5) to the paper output 30 (arrow P6).

Figure 4:
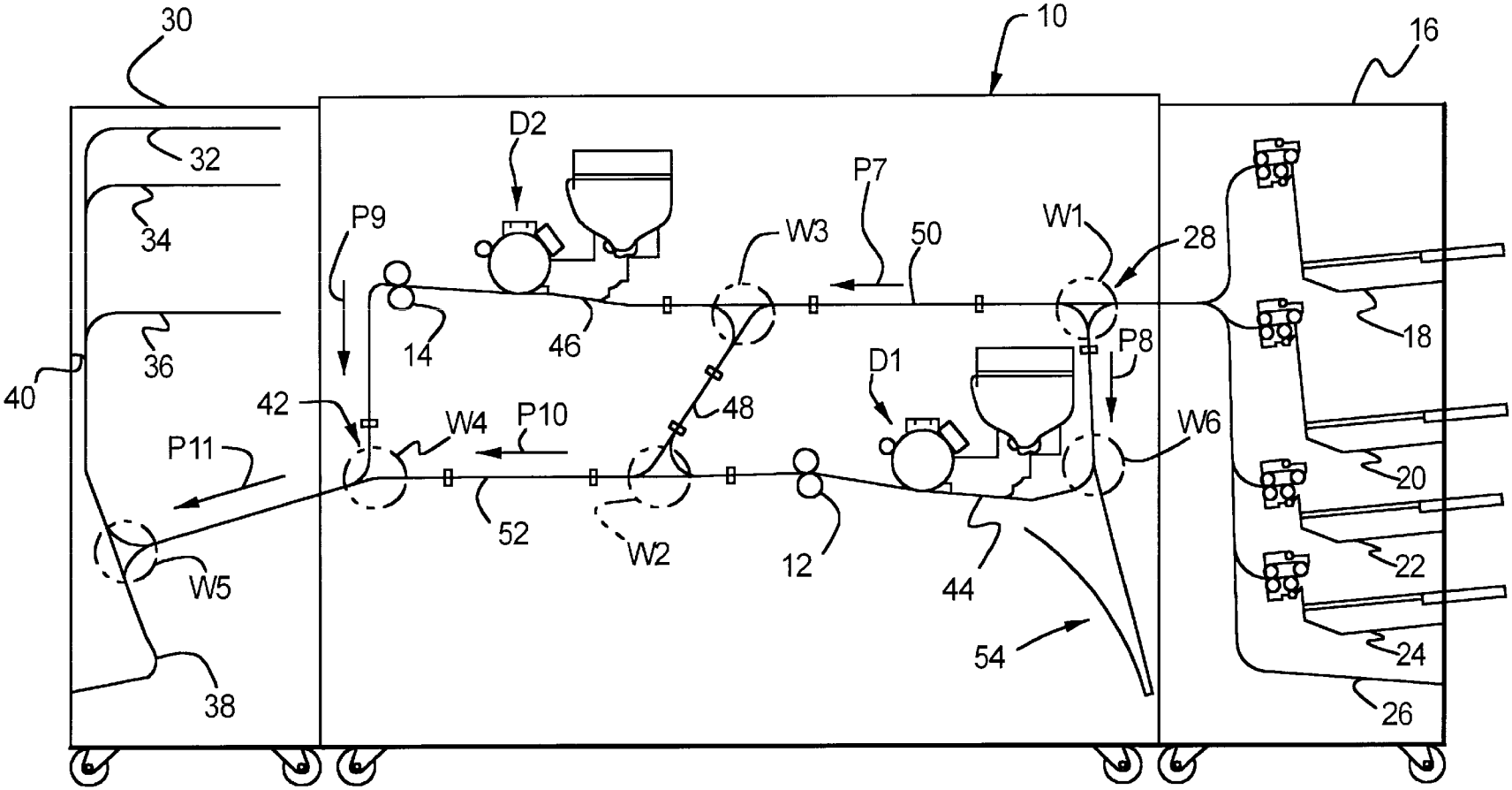
FIG. 4 shows the operating mode alternating simplex printing.

In alternating simplex printing with increased print performance, individual sheets are supplied to the printing units D1, D2 via the input unit 28 with at least twice the transfer printing speed. FIG. 4 schematically shows the transport of the individual sheets. The shunt W1 alternately guides individual sheets to the supply channel 50 or, respectively, to the first transfer printing transport path 44 (arrows P7, P8). The individual sheets are first braked to transfer printing speed on their transport up to the printing units D1, D2, are respectively printed there on the front side, and are subsequently further conveyed to the shunt W4. During this further conveying according to the arrows P9, P10, the individual sheets are accelerated to at least double the transfer printing speed, so that at the common output section they are ejected via the shunt W4 with a spacing from one another. Also, and in the paper output 30, they can be further transported one after the other according to the arrow P11 with at least twice the transfer printing speed.

In the operating mode called "alternating simplex printing," it is thus provided according to the present invention that in the paper input 16 the individual sheets at the input section 28 are supplied to the printing units D1, D2 with at least twice the transfer printing speed. In the paper output 30 as well, the individual sheets are likewise further conveyed and deposited with at least double the speed. By means of these measures, the individual sheets arrive at the common input section 28 and at the common output section 42 without the possibility of the occurrence of a collision of individual sheets and, accordingly, a paper jam. Preferably, the transport paths for the individual sheets supplied to the first printing unit D1 and the individual sheets supplied to the second printing unit D2 are of symmetrical construction, or are at least equal in length so that on both transport paths the individual sheets can be braked and accelerated with the same speed profile. In this way, it is possible to construct the drives and apparatuses required for the transport in the same way. In addition, it is possible to use control units of the same type.

Figure 5:
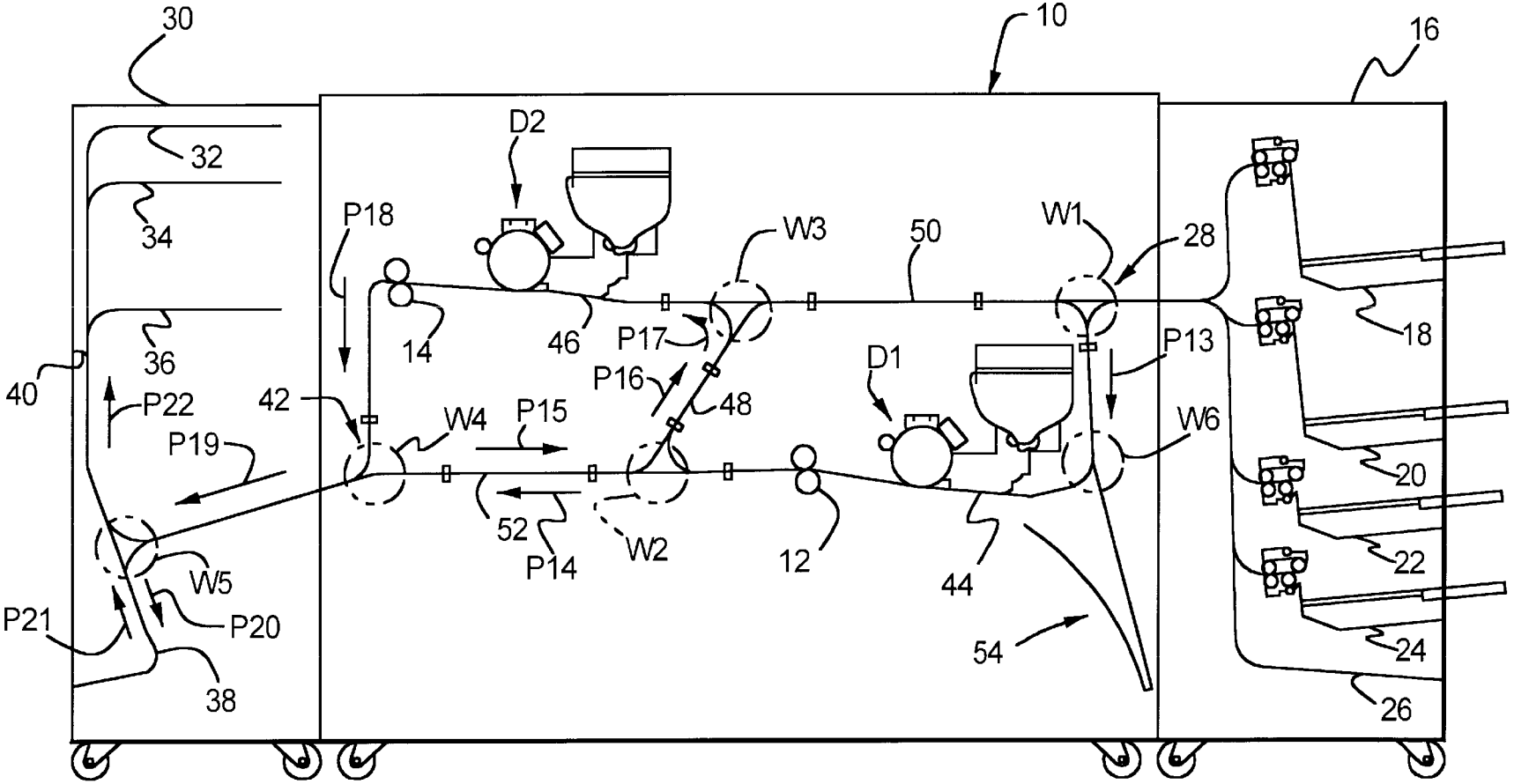
FIG. 5 shows the operating mode duplex printing.

FIG. 5 schematically shows duplex print operation in which the individual sheets are printed on both sides. The individual sheets supplied to the input section 28 are supplied to the first transfer printing transport path 44 by means of the first shunt W1 (arrow P13). After printing by the first printing unit D1, the respective individual sheet is conveyed along a turning path according to the arrow P14 via the shunt W2. This turning path is a part of the carrying-off channel 52. Subsequently, the conveying direction is reversed according to arrow P15, and the shunt W2 then guides the individual sheet into the connecting channel 48 according to the arrow P16. The individual sheet is then diverted to the second transfer printing transport path 46 in the direction of the arrow P17 by the shunt W3. The not-yet-printed back of the individual sheet is thus supplied to the printing unit D2 for printing. Subsequently, the individual sheets are supplied to the shunt W4 according to the arrow P18, and are transported into the paper output 30 along the arrow P19. Since in this state the individual sheet is transported with its back side up, it still has to be turned before being deposited into the compartments 32 to 36. The shunt W5 serves for this purpose. First, the individual sheet is guided by the shunt W5 in the direction of the arrow P20 for a predetermined turning path. The transport direction according to the arrow P21 is then reversed, and the shunt W5 conveys the individual sheet in the direction of the arrow P22, whereupon it is deposited in side-correct fashion in the deposit compartments 32 to 36.

As can be seen, the shunt W2 operates as a turning apparatus in order to supply the back of the individual sheet to the printing unit D2. Alternatively, the shunt W3 also can be used for turning. The individual sheet leaving the printing unit D1 is then guided via the shunt W2, the connecting channel 48 of the shunt W3, and then, for a short turning path, along the supply channel 50 in the direction of the shunt W1. Subsequently, the transport direction is reversed and the shunt W3 guides the individual sheet in the direction of the printing unit D2 with its back side facing up.

Figure 6:
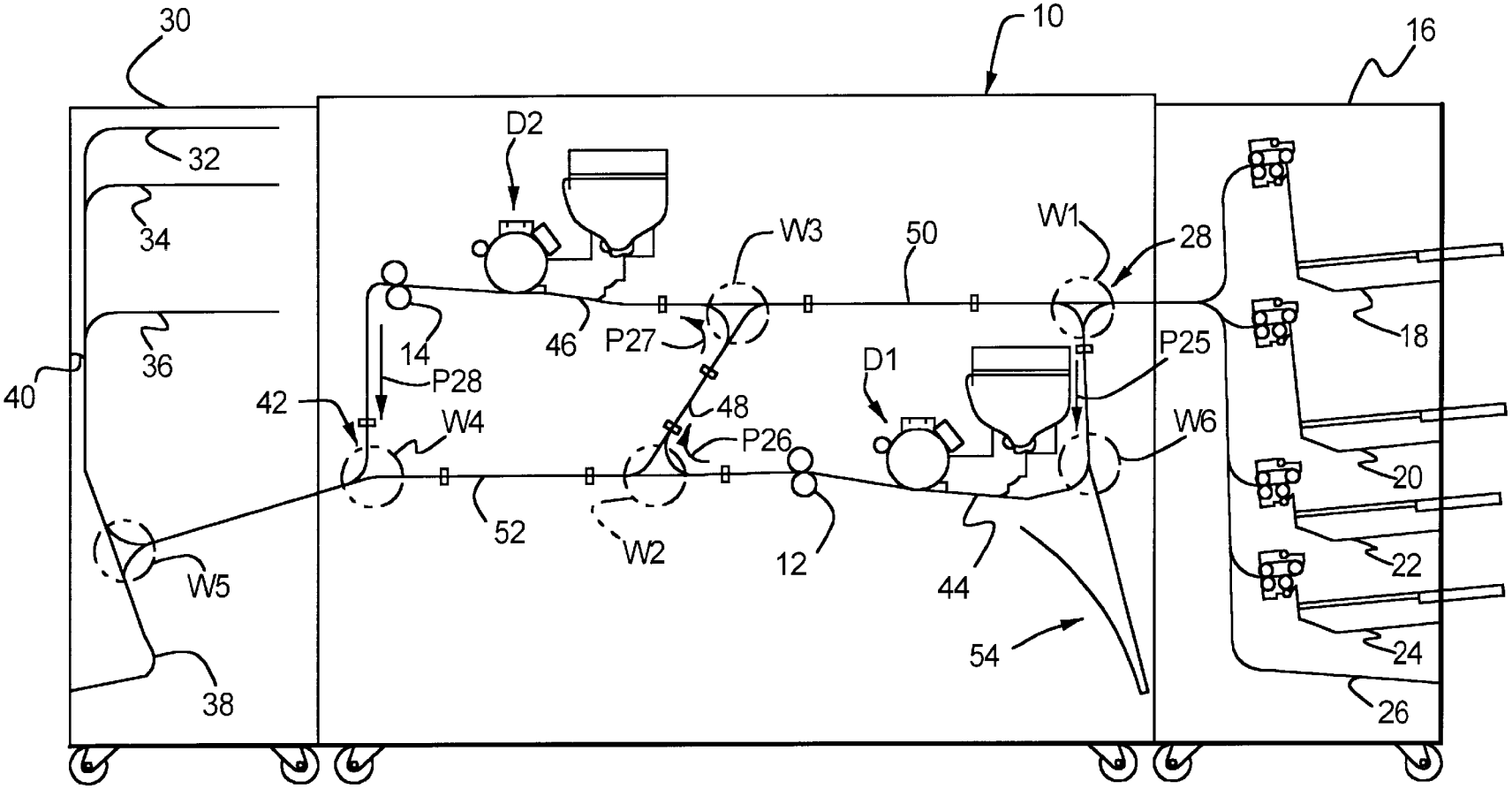
FIG. 6 shows the operating mode two-color simplex printing.

FIG. 6 schematically shows a further mode of operation, two-color simplex printing, in which the front of an individual sheet is printed with two image patterns of different colors. The two printing units D1, D2 print image patterns of different colors. In the named operating mode, two-color simplex printing, the individual sheet is supplied to the printing unit D1 via the shunt W1 (arrow P25). Subsequently, the individual sheet is supplied via the shunt W2 to the connecting channel 48, without turning, and is then supplied to the printing unit D2 via the shunt W3 (arrows P26, P27). The printing unit D2 prints the front with a color different from the color of the printing unit D1. Subsequently, the individual sheet is ejected to the paper output 30 via the shunt W4 (arrow P28).

Figure 7:
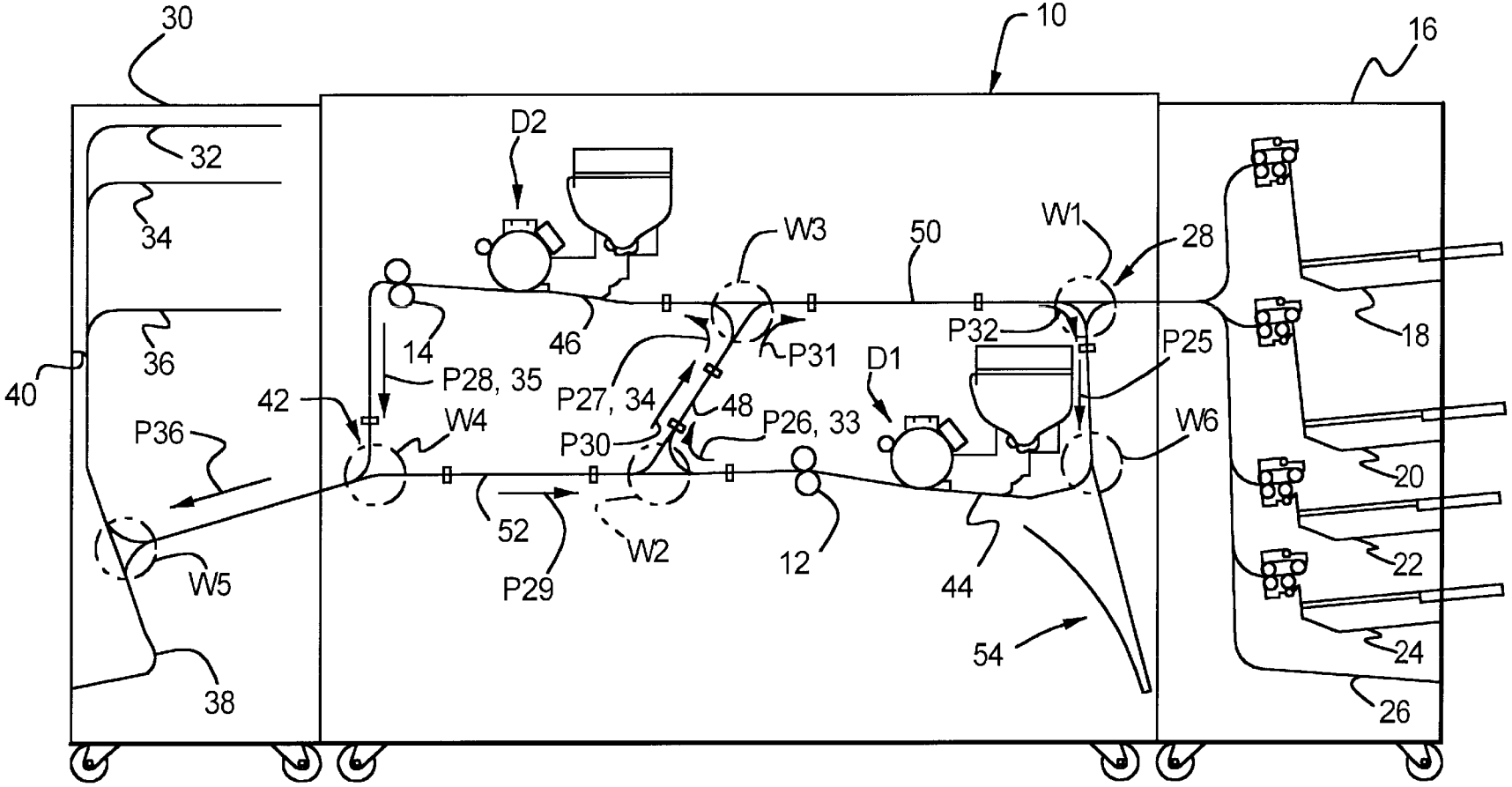
FIG. 7 schematically shows the operating mode two-color duplex printing.

FIG. 7 schematically shows the transport path of an individual sheet in the operating mode two-color duplex printing, in which the front and the back of an individual sheet are printed with image patterns of different colors. A precondition of this is that the printing units D1 and D2 print multicolored images. For the two-color printing of the front, the procedure is the same as for the operating mode two-color simplex printing as described with reference to FIG. 6. The arrows P25, P26, P27 and P28 illustrate the transport path. Subsequently, the individual sheet is again supplied to the printing unit D1. The arrows P29 to P36 illustrate the transport path of the individual sheet for the printing of the back. So that this back side is supplied to the printing unit D1, the individual sheet must be turned on the transport path between the printing unit D2 and the printing unit D1. This turning can, for example, take place at the shunt W4, the shunt W2 or the shunt W3. In a preferred embodiment of the present invention, the turning takes place using the shunt W4, i.e., the individual sheet is first transported for a short turning path in the direction of the shunt W5 where at the direction of transport is then reversed and the individual sheet is conveyed further in the direction of the shunt W2. After the transport into the paper output 30 according to the arrow P36, a further turning takes place by means of the shunt W5, and the side-correct depositing of the individual sheet, printed on both sides with, respectively, two color images, subsequently takes place.

An alternative transport of the individual sheet through the high-performance printer 10 for the realization of the operating mode two-color duplex printing can take place in the following manner. First, the individual sheet is supplied to the printing unit D1 from the input section 28 via the shunt W1, its front is printed, and it is subsequently guided briefly in the direction of the shunt W1 for turning, via the shunts W2 and W3. After passing the shunt W3, the direction of transport is changed in the direction of the printing unit D2, and the individual sheet is conveyed on the transfer printing transport path 46. The shunt W3 thus serves as a turning station. The back of the individual sheet is accordingly printed at the printing unit D2. Subsequently, the individual sheet is again supplied to the first printing unit D1 via the shunts W4, W2, W3 and W1, in order now to print the back. The individual sheet must be turned for this purpose. This takes place at the shunt W4, where it is conveyed briefly in the direction of the shunt W5, the direction of transport is reversed, and it is transported in the direction of the shunt W2 in the turned state. After the printing of the back of the individual sheet in the printing unit D1, the individual sheet is supplied to the printing unit D2 via the shunts W2 and W3, wherein it is turned. Now the front side is printed by the printing unit D2. Subsequently, the individual sheet is guided to the deposit compartments 32 to 36 via the shunt W4. Since it now moves in the correct position, i.e. with the upper side up, into the depository 30, it does not need to be turned again by the shunt W5.

Figure 8:
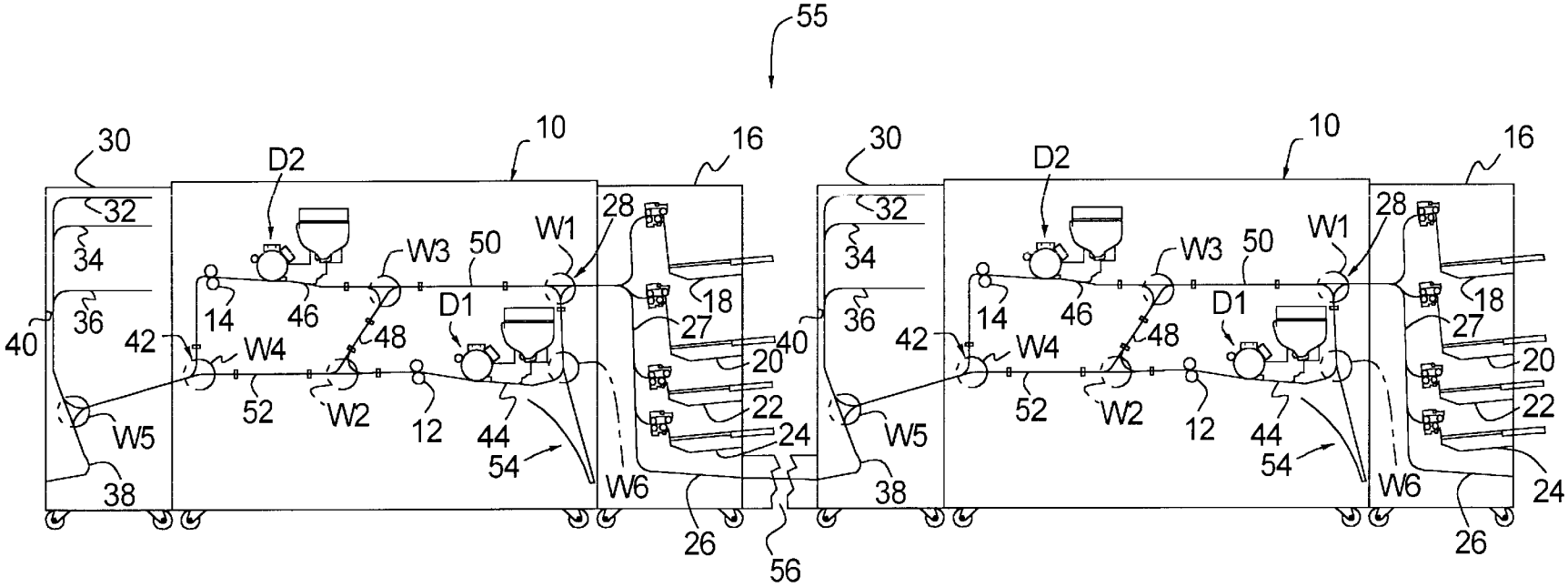
FIG. 8 shows an arrangement with two high-performance printers that are connected with one another by an interchange apparatus.

FIG. 8 shows the arrangement of two high-performance printers 10 and 10' to form a printing system 55. The two high-performance printers 10 and 10' are of identical construction so that the individual components do not need to be explained again. An interchange apparatus 56 is arranged between the ejection channel 38 of the first high-performance printer 10 and the external paper input channel 26 of the second high-performance printer 10', which apparatus conveys individual sheets from the high-performance printer 10 to the high-performance printer 10'. Each high-performance printer 10, 10' can operate in the already-described operating modes simplex printing, alternative simplex printing, two-color simplex printing, one-color simplex printing and two-color duplex printing. By combining the various operating modes, wherein a first operating mode is set in the high-performance printer 10' and an agreeing or other operating mode is set in the high-performance printer 10', new variants of operating modes are enabled. For example, both high-performance printers can operate in two-color simplex operation wherein the first printer prints the front with two differently colored image patterns and the high-performance printer 10 prints the back with two differently colored image patterns. If respectively different colors are selected for a total of four different printing units, the printing system 55 can accomplish a four-color duplex printing; i.e., the front and the back respectively can be printed with four differently colored image patterns.

The printing system 55 further can be expanded in that at least one additional high-performance printer of the type of the high-performance printer 10 is connected to the high-performance printer 10'. In this way, with the use of all the technological possibilities of the high-performance printer, an n-color duplex printing is enabled in which an individual sheet is printed on the front and on the back with n different colors, where n is an arbitrary whole number.

Although the present invention has been described with reference to specific embodiments, those of skill in the art will recognize that changes may be made thereto without departing from the spirit and scope of the invention as set forth in the hereafter appended claims.

What is claimed is:

1. A printer or copier device for sheet-type material, comprising:

an input section via which the sheet-type material is supplied individually one after another;

a first transfer printing transport path;

a first electrographic printing unit in said first transfer printing transport path with which a first image pattern is printed on the sheet-type material;

an output section via which the sheet-type material that has been printed by said first electrographic printing unit is ejected individually one after another;

a second transfer printing transport path to which the sheet-type material is supplied via said input section;

a second electrographic printing unit of substantially a same type as said first electrographic printing unit, said second electrographic printing unit being in said second transfer printing transport path and with which a second image pattern is printed on the sheet-type material, said second electrographic printing unit forwarding the sheet-type material printed by said second electrographic printing unit to said output section for output;

connecting paths connecting said first and second transfer printing transport paths to form first and second rings, said first ring of said first transfer printing transport path including:

a supply channel via which the sheet-type material is supplied to said second transfer printing transport path from said input section;

said second ring of said second transfer printing transport path including:

a carry-off channel via which the sheet-type material printed by said first electrographic printing unit is supplied to said output section; and a connecting channel connecting said first transfer printing transport path and said second transfer printing transport path with which the sheet-type material is conveyed in one or in both transport directions.

2. A printer or copier device as claimed in claim 1, further comprising:

two shunts connecting said first and second rings with one another, each of said two shunts being a three-way shunt so that a plurality of different transport paths arises for the sheet-type material.

3. A printer or copier device as claimed in claim 2, further comprising:

a further shunt at said input section that supplies sheet-type material either to said first transfer printing transport path or to said second transfer printing transport path.

4. A printer or copier device as claimed in claim 3, wherein said further shunt supplies the sheet-type material alternately to said first transfer printing transport path and to said second transfer printing transport path.

5. A printer or copier device as claimed in claim 1, wherein said first and second rings are constructed and operated such that the sheet-type material printed by a corresponding one of said first and second electrographic printing units in a first printing event is resupplied to said corresponding one of said first and second electrographic printing units such that the sheet-type material passes through said corresponding one of said first and second electrographic printing units in a same direction as in the first printing event; and further comprising:

a first shunt with which the sheet-type material in said first ring is turned over provided at said first ring; and a second shunt with which the sheet-type material in said second ring is turned over provided at said second ring.

6. A printer or copier device as claimed in claim 1, further comprising:

a turning apparatus by which during transport of the sheet-type material from said first transfer printing transport path to said second transfer printing transport path, and vice versa, the sheet-type material is turned over.

7. A printer or copier device as claimed in claim 1, further comprising:

a first output channel connected to said output section.

8. A printer or copier device as claimed in claim 7, further comprising:

a second output channel connected to said output section via which the sheet-type material is output to a further-processing station.

9. A printer or copier device as claimed in claim 1, wherein said connecting channel supplies the sheet-type material from the first transfer printing transport path without turning to the second transfer printing transport path.

10. A printer or copier device as claimed in claim 1, wherein said connecting channel supplies the sheet-type material from said first transfer printing transport path and to said second transfer printing transport path, and supplies the sheet-type material printed by said second printing unit again to said first transfer printing transport path after being turned, and subsequently supplies the sheet-type material to said second transfer printing transport path without turning.

11. A printer or copier device as claimed in claim 1, wherein said first transfer printing transport path and said connecting channel and said supply channel form a closed transport path, said supply channel being capable of transporting the sheet-type material in both directions and being capable of supplying the sheet-type material to said second transfer printing transport path.

12. A printer or copier device as claimed in claim 1, wherein said second transfer printing transport path and said connecting channel and said carry-off channel for the sheet-type material form a closed transport path, said carry-off channel being capable of conveying sheet-type material in both directions and connecting said first transfer printing transport path with said output section.

13. A printer or copier device as claimed in claim 1, wherein said first electrographic printing unit prints image patterns with a first color, and said second electrographic printing unit prints image patterns with a second color different from the first color.

14. A printer or copier device as claimed in claim 1, further comprising:

a turning apparatus operable to turn over the sheet-type material and arranged after said output section in a direction of conveying of the sheet-type material.

15. A printer or copier device as claimed in claim 1, further comprising:

a paper input arranged before said input section relative to a direction of conveying, said paper input providing the sheet-type material in different supply reservoirs.

16. A printer or copier device as claimed in claim 1, a paper output arranged after said output section in a direction of conveying, said paper output including several supply containers into which the sheet-type material is deposited.

17. A printer or copier device as claimed in claim 1, further comprising:

a first shunt at said input section;

a second shunt at a connection between said first transfer printing transport path and said connecting channel and said carry-off channel;

a third shunt at a connection between said connecting channel and said second transfer printing transport path and said supply channel; and a fourth shunt at a connection between said second transfer printing transport path and said carry-off channel.

18. A printer or copier device as claimed in claim 17, further comprising:

a control to effect an operating mode for two-color duplex printing with two colors per side, the sheet-type material being supplied to said first electrographic printing unit via said input section and said first shunt and is printed by said first electrographic printing unit with a first color, the sheet-type material being transported to said second electrographic printing unit via said second shunt and said third shunt and being printed there with a second color, for printing of a second side, the sheet-type material being transported to said fourth shunt, after passing through said fourth shunt the sheet-type material being transported into a turning over section, the direction of transport being reversed and changed to a direction of said second shunt, and the sheet-type material being supplied to said first electrographic printing unit via said third shunt and said first shunt, and being printed with the first color, the sheet-type material being transported to said second electrographic printing unit via said second shunt and said third shunt and being printed with a second color, and the sheet-type material being ejected via said fourth shunt.

19. A printer or copier device as claimed in claim 17, further comprising:

a control to effect an operating mode for two-color duplex printing with two colors per side, a front side of the sheet-type material being supplied to said first electrographic printing unit via said input section and said first shunt and being printed by said first electrographic printing unit with a first color, the sheet-type material being transported after turning over to said second electrographic printing unit via said second shunt and said third shunt, and a back side of the sheet-type material being printed with a second color, the back side of the sheet-type material being supplied to said first electrographic printing unit via said fourth shunt and said second shunt and said third shunt and said first shunt and being printed with the first color, the sheet-type material being supplied after turning over to said second electrographic printing unit via said second shunt and said third shunt and being printed with the second color, and the sheet-type material being ejected via said fourth shunt.

20. A printer or copier device as claimed in claim 1, wherein the sheet-type material is supplied to said input section with a speed equal to or greater than twice a transfer printing speed of said first and second electrographic printing units, and the sheet-type material is braked to the transfer printing speed before reaching a respective one of said first and second electrographic printing units.

21. A printer or copier device as claimed in claim 20, wherein in its transport from the respective one of said first and second electrographic printing units to said output section the sheet-type material is accelerated to a speed that is equal to or greater than twice the speed of the transfer printing speed of said first and second electrographic printing units.

22. A printer or copier device as claimed in claim 1, further comprising:

a second printer or copier device of a same type as claimed in claim 1, wherein said output section is connected with an interchange apparatus that is connected with an input section of said second printer or copier device.

23. A printer or copier device as claimed in claim 22, wherein both the printer or copier devices contain printing units that print multicolored image patterns.

24. A printer or copier device as claimed in claim 22, further comprising:

at least one further device of a same type is connected to the second device.

25. A method for operating a printer or copier device, comprising the steps of:

supplying sheet-type material individually one after another via an input section;

printing an image pattern on the sheet-type material in a first transfer printing transport path with a first electrographic printing unit;

ejecting the printed sheet-type material individually one after another via an output section;

supplying the sheet-type material to a second transfer printing transport path via the input section;

printing an image pattern on the sheet-type material with a second printing unit of substantially a same type as said first electrographic printing unit, said second printing unit being in the second transfer printing transport path;

outputting the sheet-type material printed by the second printing unit via the output section;

forming two rings by connecting the two transfer printing transport paths via connecting paths;

supplying the sheet-type material via a supply channel of the ring of the first transfer printing transport path to the second transfer printing transport path from the input section;

supplying the sheet-type material printed by the first printing unit via a carry-off channel of the ring of the second transfer printing transport path to the output section; and transporting the sheet-type material in a first transport direction in a first operating condition and transporting the sheet-type material in a second transport direction in a second operating condition, said transporting being through a connecting channel that connects the first transfer printing transport path and the second transfer printing transfer path.

* * * * *